US005692547A

United States Patent [19]

Lehr

[11] Patent Number: 5,692,547

[45] Date of Patent: Dec. 2, 1997

[54] ANTI-SPILLAGE ABSORBENT DEVICE FOR USE WHEN FILLING A FUEL TANK, PACKAGE, AND METHOD

[76] Inventor: William F. Lehr, 100 Lewis Dr., Unit 10-A, Greenville, S.C. 29605

[21] Appl. No.: 686,463

[22] Filed: Jul. 25, 1996

[51] Int. Cl.[6] ..... B65B 1/04

[52] U.S. Cl. ..... 141/86; 141/392; 114/364

[58] Field of Search ..... 141/86, 390, 392; 239/104, 120, 121; 114/343, 364; 220/573

[56] References Cited

U.S. PATENT DOCUMENTS 3,451,445 6/1969 Sippola .

5,329,974 7/1994 Paping ..... 141/86

5,566,731 10/1996 Holland ..... 141/86

*Primary Examiner*—Henry J. Recla

*Assistant Examiner*—Steven O. Douglas

*Attorney, Agent, or Firm*—Ralph Bailey

[57] ABSTRACT

Absorbent devices for receiving fuel spill during the filling of a fuel tank include a gasket (A) constructed from a matrix of melt blown polypropylene fibers and frictionally held upon the fuel nozzle below the handle on the spout having outer surfaces (B) for engaging an entrance to the fuel tank and a central passageway defined by compliant walls for preventing fuel surges from backing up out the fuel tank. A squeezable pillow (D) provides adhesive attachment for positioning for receiving spillage from a fuel vent.

7 Claims, 3 Drawing Sheets

ANTI-SPILLAGE ABSORBENT DEVICE FOR USE WHEN FILLING A FUEL TANK, PACKAGE, AND METHOD

BACKGROUND OF THE INVENTION

This invention relates to absorbent gaskets and pads especially useful in fueling marine fuel tanks and method.

The problem of fuel spills from surges that occur during fueling as a result of air in the fuel tank have been addressed with varying degrees of success. Splash plates or shields on the dispensing nozzle adjacent the handle, as illustrated in U.S. Pat. No. 3,739,988, have long been utilized. Problems persist in that fuel surges back past the shield and in the case of boats pollute the water with a film of oil. The problem of fuel spills has been addressed in U.S. Pat. No. Re. 31,087 which is directed to apparatus and method utilizing oleophilic fibers including polypropylene for receiving and retaining oil spilled into water. U.S. Pat. No. 3,451,445 illustrates a form of baffle or spillage catcher fabricated of spongy material which is placed either around the inlet orifice to the fuel tank or else it is carried on the tip of the nozzle so as to project into the inlet orifice of the fuel tank.

U.S. Pat. No. 5,070,806 illustrates the use of a container for receiving the overflow from a fuel leakage vent as is commonly utilized in connection with a fuel tank of marine application. An absorbent device for receiving fuel spills from surges has been provided for placement upon the nozzle adjacent the handle for marine applications wherein the fuel which is received turns the device into a rubberlike solid. The spillage remains in the fuel absorber where it is ultimately disposed of while still contained in the rubberlike solid form thus increasing the possibility of pollution. This device is sold under the trademarks Fueling Friend and Fueling Friend Jr. by Advanced Aquatic Products International, Inc. Of Key West, Fla.

Other patents illustrative of the prior art include U.S. Pat. Nos. 2,058,118, 2,467,001, 2,659,523, 2,555,868, 3,211,196, 4,817,691, and 4,830,067.

SUMMARY OF THE INVENTION

Accordingly it is an important object of the invention to provide apparatus and method for avoiding and containing spills of fuel, especially on boats where spilled fuel pollutes the water, although the absorbent devices and method of the invention have application to automotive fueling as well. Marine applications in addition to an absorbent ring or gasket contemplate an absorbent overflow pad or pillow which may be packaged together with the ring.

The absorbent gasket and the overflow pad utilize a matrix of polyolefin fibers, principally melt blown polypropylene, as an absorbent gasket and pad to prevent fuel splash back from the fuel fill entrance and overspill from the tank vent on a boat.

The fiber matrix is melt blown polypropylene, a fiber matrix produced by melting a polypropylene polymer pellet mass, forcing the melt through a fiber forming spinarette into an atmosphere conducive to producing a high loft, or surface to weight ratio, similar to "cotton candy", this high surface area to low weight fiber mass being inherently hydrophobic (oleophilic), absorbing up to twenty times its own weight in hydrocarbon fuels.

The interiors of the devices hereof are filled with high loft, melt blown polypropylene in either fiber fill, fabric sheets, or spaghetti-like strips. The outer jacket or cover is made from melt blown polypropylene needle punched fabric. The needle punch fabric is desirable due to its strength and its ability to be sewn or seam welded into a strong absorptive, but nonrupturable, container for the fill. Other jacket materials are also acceptable, namely knit casings of nylon, polyethylene or polypropylene net enclosures, or any open net or knitted container allowing immediate and unrestricted access of the fuel to the interior fiber fill.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a package containing absorbent anti-spillage devices for receiving fuel spilled when filling a marine fuel tank with a hydrocarbon fuel having an overflow port for permitting the passage of excess fuel from the fuel tank including a generally toroidal gasket A constructed from a matrix of melt blown polypropylene fibers applied to and frictionally held upon the fuel nozzle below the handle on the spout. The gasket has an outer bearing surface B for facing toward the entrance to the fuel tank abutting and in bearing relation about the entrance to fuel tank when the spout is inserted into the fuel tank for dispensing fuel. The gasket also has a passageway C having compliant walls formed generally centrally of the gasket for conforming to the nozzle preventing the unobstructed flow of fuel between the gasket and the nozzle when fuel surges occur during the dispensation of fuel when the gasket is applied between the handle and the spout. A squeezable body is formed by the matrix receiving fuel during dispensing thereof into the fuel tank wherein a greater part of the fuel thus received may be removed by wringing out the matrix thereby avoiding contamination of the environment when discarding the anti-spillage devices. A squeezable pillow D is constructed from a matrix of melt blown polypropylene fiber attachable for receiving fuel from the overflow port when filling a marine fuel tank. A suitable adhesive medium is provided for attaching the pillow for receiving the fuel. A containment device such as a clear plastic bag is provided for packaging a gasket and a pillow.

Figure 1:
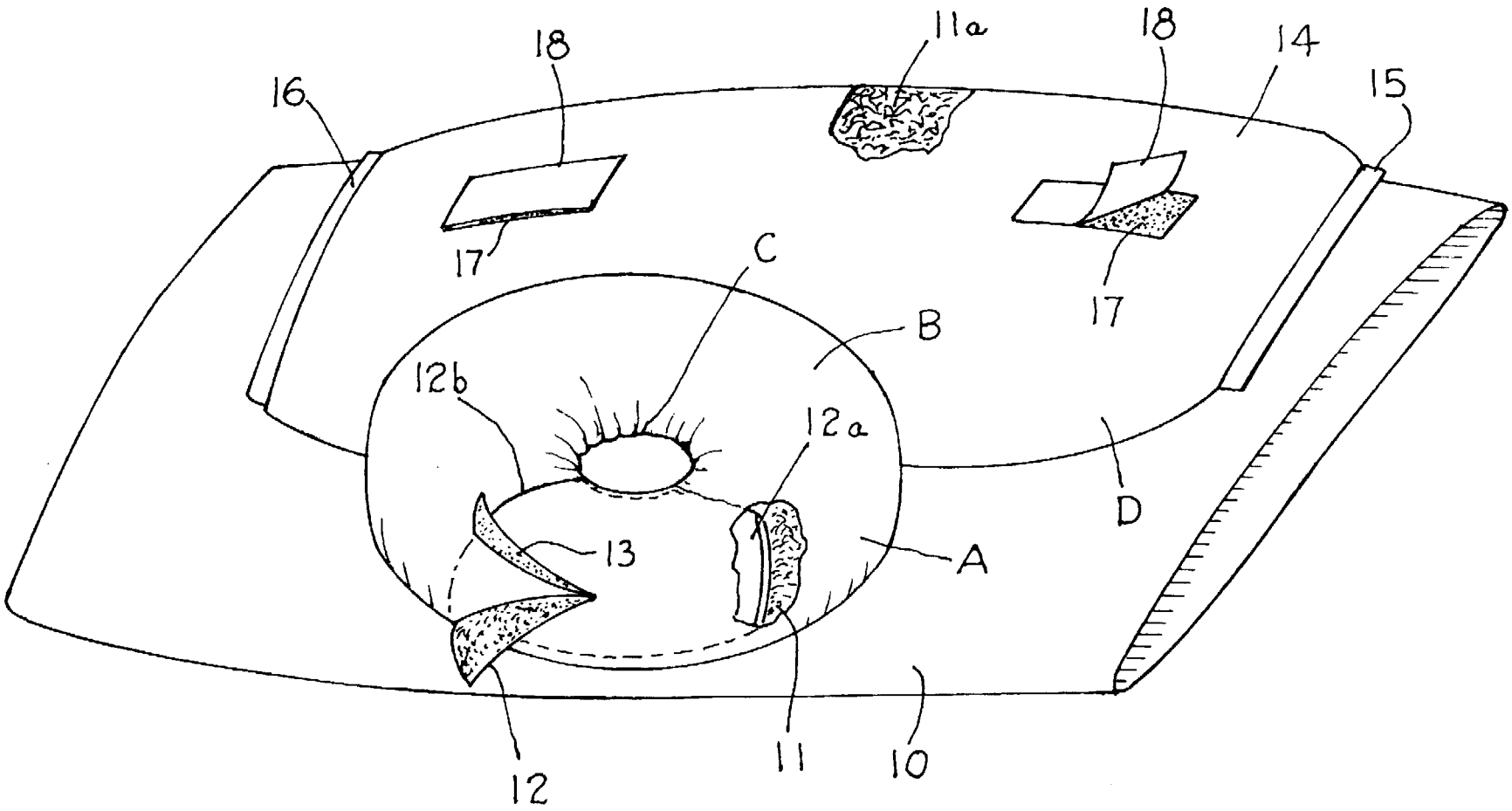
FIG. 1 is a perspective view illustrating a package containing a generally toroidal gasket constructed from a matrix of melt blown polypropylene fibers for positioning upon a fuel nozzle below the handle on the spout together with a pillow likewise constructed of a matrix of melt blown polypropylene fiber together with a plastic bag containing the gasket and the pillow as a package.

Referring more particularly to FIG. 1, the package includes a suitable containment device such as the plastic bag 10. The toroidal gasket A includes a matrix of melt blown polypropylene fibers as indicated at 11. A cover is illustrated at 12 in the form of a sleeve extending over the polypropylene fibers having one end 12a received within the other end 12b. A suitable sealing material such as glue 13 is provided to join the ends of the cover 12. It should be noted that a cover may assume the form of a surface to which a suitable binder has been applied to act as a cover or skin or it may be possible that a cover may be provided by melting a surface layer of the matrix.

The pillow includes a matrix 11a of melt blown polypropylene fibers. A cover 14 preferably of nonwoven melt blown polypropylene fibers illustrated at 14 is heat sealed at each end as at 15 and 16. Any other suitable cover may be utilized. The pillow is provided on an inner surface with a pressure sensitive adhesive 17 attached to the cover 14 and is provided with a pealable protective tab 18.

Figure 2:
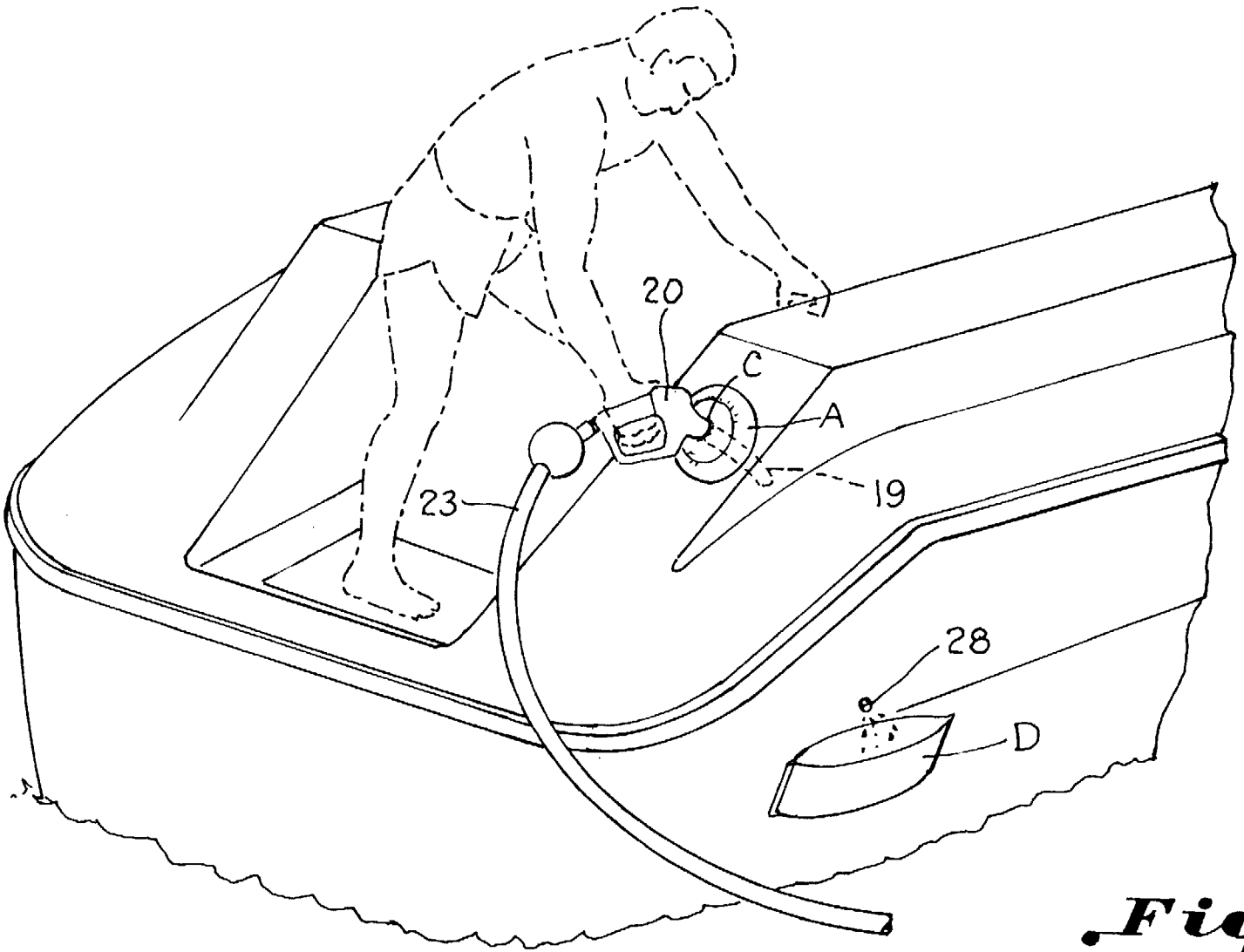
FIG. 2 is a perspective view illustrating the fueling of a boat utilizing a toridal gasket abutting the entrance to the fuel tank with the pillow in position to contain any spillage from the fueling vent.
Figure 3:
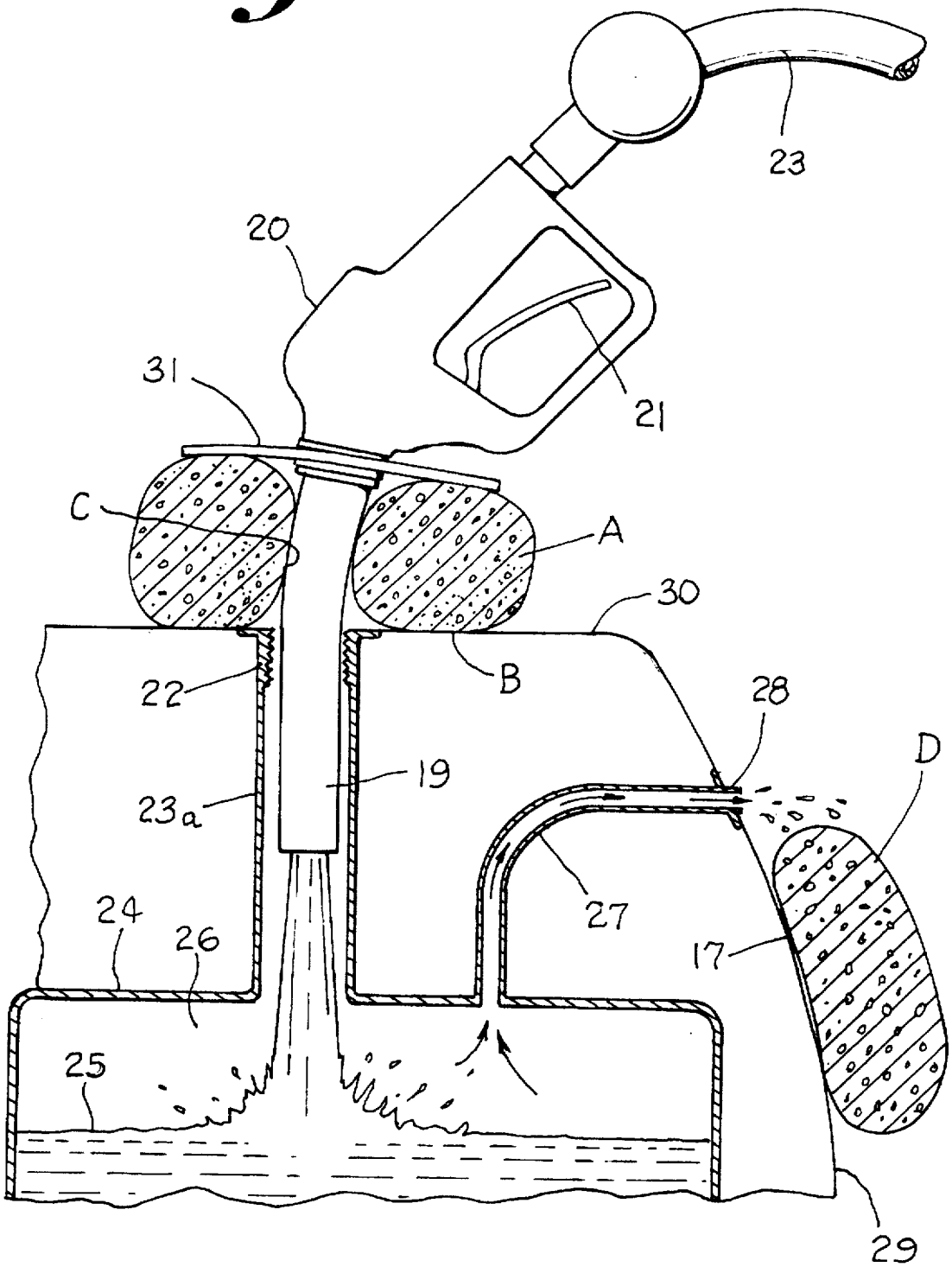
FIG. 3 is a transverse sectional elevation at an enlarged scale illustrating the positioning of the gasket ring and the pillow in relation to the nozzle and the fuel vent, respectively.

FIG. 2 illustrates a fuel nozzle having a spout 19 carried by a handle 20 which incorporates a valve and valve handle 21. The housing 20 containing the valve is pivotally secured to a fuel line 23. The spout 19 is illustrated in FIG. 3 as extending into an opening defined in a threaded entrance 22 to the line 23a which extends downwardly to a fuel tank 24 which is illustrated as containing a fuel tank 25 and an air space 26 thereabove. A line 27 opens in a fuel spill vent designated as at 28 illustrated as including an opening in the side 29 of the boat. The fuel tank opens by way of the entrance 22 into an upper or deck surface 30 of the boat.

FIG. 3 incorporates the usual splash shield 31 which in this instance is positioned on the nozzle spout adjacent the handle 20. It is advantageous to utilize a splash shield because it performs an additional function of pressing against the gasket assuring a seal wherein the gasket bears against the entrance to the fuel tank.

The devices described herein will generally absorb up to twenty times their weight in hydrocarbon fuel. An experiment was conducted with both sizes of fueling devices with the following results:

| | Maximum Amount Of Fuel Absorbed | Amount of Fuel Retained after Squeezing |
|---|---|---|
| 3" × 6" Ring | 32 oz. | 10–12 oz. |
| 5" × 15" Pillow | 48 oz. | 16–18 oz. |
| 3" × 12" Ring | 80 oz. | 27–30 oz. |
| 18" × 24" Pillow | 192 oz. | 64–70 oz. |

While a preferred embodiment of the invention has been described using specific terms, such description is for illustrative purposes only, and it is to be understood that changes and variations may be made without departing from the spirit or scope of the following claims.

What is claimed is:

1. An anti-spillage absorbent device for use on a fuel nozzle having a handle and a spout to avoid fuel surge back spills when filling a fuel tank with the spout inserted into the entrance to the fuel tank dispensing hydrocarbon fuel comprising:

a generally toroidal gasket constructed from a matrix of melt blown polypropylene fibers adapted to be, applied to and frictionally held upon the fuel nozzle below the handle on the spout;

a cover containing said matrix providing an outer bearing surface on said gasket for facing toward the entrance to the fuel tank abutting and in bearing relation about said entrance to fuel tank when the spout is inserted into the fuel tank for dispensing fuel;

a passageway defined by compliant walls formed generally centrally of said gasket for conforming to said nozzle preventing the unobstructed flow of fuel between the gasket and the nozzle when fuel surges occur during the dispensation of fuel when said gasket is applied between the handle and the spout; and a squeezable body formed by said matrix receiving fuel during dispensing thereof into the fuel tank wherein a greater part of the fuel thus received may be removed by wringing out the matrix thereby avoiding contamination of the environment when discarding the anti-spillage device; whereby fuel surge back spills are avoided by receiving and retaining fuel which would have been spilled within said matrix preparatory to removal by squeezing and discarding thereof.

2. The anti-spillage shield set forth in claim 1 wherein said cover for said matrix comprises a rolled non-woven sheet constructed of melt blown polypropylene fibers joined at ends of the sheet.

3. A package containing anti-spillage devices for receiving fuel spilled when filling a marine fuel tank with a hydrocarbon fuel having an overflow port for permitting the passage of excess fuel from the fuel tank comprising:

a generally toroidal gasket constructed from a matrix of melt blown polypropylene fibers adapted to be, applied to and frictionally held upon the fuel nozzle below the handle on the spout;

an outer bearing surface on said gasket for facing toward the entrance to the fuel tank abutting and in bearing relation about the entrance to fuel tank when the spout is inserted into the fuel tank for dispensing fuel;

a passageway having compliant walls formed generally centrally of said gasket for conforming to said nozzle preventing the unobstructed flow of fuel between the gasket and the nozzle when fuel surges occur during the dispensation of fuel when said gasket is applied between the handle and the spout; and a squeezable body formed by said matrix receiving fuel during dispensing thereof into the fuel tank wherein a greater part of the fuel thus received may be removed by wringing out the matrix thereby avoiding contamination of the environment when discarding the anti-spillage devices;

a squeezable pillow is constructed from a matrix of melt blown polypropylene fiber attachable for receiving fuel from said overflow port when filling said marine fuel tank;

an adhesive medium for attaching said pillow for receiving said fuel; and a containment for said gasket and said pillow.

4. The method of avoiding spillage and contamination when dispensing hydrocarbon fuel from a nozzle having a handle and a spout entering a fuel tank for dispensing fuel therein by use of an anti-spillage shield, comprising the steps of:

positioning a generally toroidal gasket constructed from a matrix of melt blown polypropylene fibers upon the fuel nozzle between the handle and the spout;

securing a compliant passageway formed generally centrally of said matrix for conforming to said nozzle preventing the unobstructed flow of fuel between the gasket and the nozzle when fuel surges occur during the dispensation of fuel when said gasket is applied below the handle on the spout;

pressing an outer bearing member on said gasket toward the entrance to the fuel tank abutting and in bearing relation about the entrance to fuel tank when the spout is inserted into the fuel tank for dispensing fuel; and discarding the anti-spillage shield.

5. The method of avoiding spillage and contamination set forth in claim 4 including the step of adhesively affixing a pillow constructed of melt blown polypropylene to a surface of a boat extending adjacent an overflow port when fueling for receiving fuel overflowing from said port.

6. The method set forth in claim 4 including the step of:

squeezing a body formed by said matrix receiving fuel during dispensing thereof into the fuel tank so that a greater part of the fuel thus received is removed by wringing out the matrix and retaining such fuel thereby avoiding contamination of the environment prior to discarding the anti-spillage shield.

7. The method set forth in claim 4 including positioning said gasket on said nozzle beneath a splash shield adjacent the handle; and pressing said handle and shield against said gasket opposite said bearing member.

* * * * *